US011737188B2

(12) United States Patent
Auer et al.

(10) Patent No.: US 11,737,188 B2
(45) Date of Patent: Aug. 22, 2023

(54) LED-DRIVER WITH PFC AND WIRED BUS INTERFACE

(71) Applicant: Tridonic GmbH & Co KG, Dornbirn (AT)

(72) Inventors: Hans Auer, Dornbirn (AT); Clemens Kucera, Bludenz (AT); Lukas Saccavini, Dornbirn (AT); Stefan Stark, Muntlix (AT)

(73) Assignee: Tridonic GmbH & Co KG, Dornbirn (AT)

( * ) Notice: Subject to any disclaimer, the term of this patent is extended or adjusted under 35 U.S.C. 154(b) by 0 days.

(21) Appl. No.: 17/772,235

(22) PCT Filed: Nov. 10, 2020

(86) PCT No.: PCT/EP2020/081613
§ 371 (c)(1),
(2) Date: Apr. 27, 2022

(87) PCT Pub. No.: WO2021/094300
PCT Pub. Date: May 20, 2021

(65) Prior Publication Data

US 2022/0377860 A1 Nov. 24, 2022

(30) Foreign Application Priority Data

Nov. 14, 2019 (EP) ..... 19209179

(51) Int. Cl.
*H05B 45/30* (2020.01)
*H05B 45/355* (2020.01)
*H05B 47/185* (2020.01)

(52) U.S. Cl.
CPC ..... *H05B 45/355* (2020.01); *H05B 47/185* (2020.01)

(58) Field of Classification Search
CPC .. H05B 45/325; H05B 45/345; H05B 45/355; H05B 45/382; H05B 45/385; H05B 45/3725; H05B 47/175; H05B 47/185
See application file for complete search history.

(56) References Cited

U.S. PATENT DOCUMENTS 8,704,452 B2 * 4/2014 Wu ..... H05B 47/10 315/307
9,445,464 B2 9/2016 Mitterbacher
(Continued)

FOREIGN PATENT DOCUMENTS

TW 201244533 11/2012
WO 2009118123 10/2009

OTHER PUBLICATIONS

PCT/EP2020/081613, International Search Report and Written Opinion dated Feb. 3, 2021, 17 pages.

*Primary Examiner* — Tung X Le
(74) *Attorney, Agent, or Firm* — Andrus Intellectual Property Law, LLP

(57) ABSTRACT

The invention relates to an LED-driver, comprising an actively switched PFC circuitry and a bus interface for a wire-bound bus, wherein a voltage supply for the bus interface for powering the bus is tapped off the output voltage of the active PFC circuitry, further comprising a control circuitry for a feedback control of an output voltage of the actively switched PFC by controlling a switch of the PFC, wherein the time constant of the feedback control of the control circuitry is faster during time periods in which the bus interface is transmitting or receiving signals, compared to time periods without activity.

11 Claims, 5 Drawing Sheets

(56) References Cited

U.S. PATENT DOCUMENTS

| | | | | |
|---|---|---|---|---|
| 9,537,407 | B2 * | 1/2017 | Fang | H05B 45/385 |
| 11,206,727 | B1 * | 12/2021 | Palliyil Chundethodiyil | H05B 45/34 |
| 2004/0140777 | A1 | 7/2004 | Fosler | |
| 2014/0001962 | A1 | 1/2014 | Harris | |
| 2015/0334797 | A1 * | 11/2015 | Vonach | H02M 7/53803 315/219 |
| 2017/0086272 | A1 * | 3/2017 | O'Neil | H05B 45/56 |
| 2018/0262102 | A1 * | 9/2018 | Marent | H02M 1/4225 |

* cited by examiner

LED-DRIVER WITH PFC AND WIRED BUS INTERFACE

CROSS REFERENCE TO RELATED APPLICATIONS

The present application is the U.S. national stage application of international application PCT/EP2020/081613 filed Nov. 10, 2020, which international application was published on May 20, 2021 as International Publication WO 2021/094300 A1. The international application claims priority to European Patent Application No. 19209179.1 filed Nov. 14, 2019.

TECHNICAL FIELD OF THE INVENTION

The invention relates to an LED-driver. The invention further relates to a method for reducing fluctuations on the LED-driver.

BACKGROUND OF THE INVENTION

In many operating devices for light-emitting means, it is conventional for the light-emitting means to be operated either at a high frequency, in particular in the case of gas discharge lamps, or else by means of pulse modulation, for example in the case of LEDs. For this purpose, so-called driver circuits are provided, which can be in the form of a pulse modulator, a full-bridge or half-bridge circuit, etc. Generally, a DC link voltage is supplied to these driver circuits, which DC link voltage may have a so-called ripple superimposed on it, if appropriate.

In order to provide this DC link voltage, often a so-called PFC (power factor correction) circuit, also referred to as active power factor correction circuit, is used. This PFC circuit generates the DC link voltage on the basis of a generally rectified mains supply voltage whilst maintaining a power factor which is as high as possible.

Furthermore, the so-called digital addressable lighting interface (DALI) provides two-way communications between lighting fixtures ("luminaires"), ballasts and controllers in buildings. It is defined in IEC technical standards IEC 62386 and IEC 60929, which cover LED drivers and electronic ballasts used in AC supplies with voltages up to 1000 V and with operating frequencies of 50 Hz or 60 Hz.

DALI uses Manchester-encoded 0 to 20 V signaling that enables a controller to address individual lights in a network or to broadcast commands to groups of lights in a zone.

Communication from the lights back to the controller is also possible, for reporting of parameters such as energy consumption and device failures.

DALI system cabling requirements are similar to conventional unidirectional 0 to 10 V controlled circuits deployed in commercial and industrial facilities. However, with DALI, the LED drivers and ballasts can be linked to a central computer, allowing each to be controlled independently.

LED drivers and ballasts can be connected to make up a group of LED drivers or ballasts. Each device is allocated an address, and the group is connected to a DALI controller. DALI does not require any hardwired power circuit control groups, but allows free-form network layout: daisy chain, star topology and multidrop are all permitted. A combination of two or more topologies is also allowed.

The diagrams in FIG. 1 and FIG. 2 show what typical DALI frames look like.

In particular, forward frames are packets sent by a controller to the lighting/ballast device. They consist of one start bit, eight address bits, eight data bits and two stop bits. The bits are sent most significant bits (MSB) first.

A backward frame is the response packet sent by the control gear back to the controller. It consists of one start bit, eight data bits and two stop bits.

The invention is generally in the field of driver for lighting means, such as for example LEDs, which driver have an integrated DALI power supply. As known as such in the prior art, the DALI supply voltage can be tapped-off after the PFC circuitry, and thus prior to the supply of the DC bus voltage to a following converter stage, such as for example a LLC.

However, during DALI bus activities (falling and rising edges on the DALI bus), this tapping-off at the DC bus stage will lead to fluctuations and/or dips in the bus voltage, which can lead to the problem that these fluctuations are actually visible in the light output of the lighting means supplied by the following converter stage.

Currently, once the dim level is lower than a certain level, the PFC controller is switched to fast operation which reduces DALI frame disturbance on $V_{bus}$, but worsens the total harmonic distortion (THD) performance.

Thus, it is an objective to provide an improved LED-driver with reduced fluctuations.

SUMMARY OF THE INVENTION

The object of the present invention is achieved by the solution provided in the enclosed independent claims. Advantageous implementations of the present invention are further defined in the dependent claims.

According to a first aspect of the invention, an LED-driver is provided. The LED-driver comprises an actively switched PFC circuitry and a bus interface for a wire-bound bus, wherein a voltage supply for the bus interface for powering the bus is tapped off the output voltage of the active PFC circuitry, further comprising a control circuitry for a feedback control of an output voltage of the actively switched PFC by controlling a switch of the PFC, wherein the time constant of the feedback control of the control circuitry is faster during time periods in which the bus interface is transmitting or receiving signals, compared to time periods without activity.

This provides the advantage that during DALI bus activities (falling and rising edges on the DALI bus), the fluctuations due to the tapping-off at the DC bus stage, which can be visible in the light output of the lighting means supplied by the following converter stage, are reduced.

In an embodiment the LED driver comprises a bus power supply unit, preferably supplied by the output voltage of the PFC circuitry, supplying DC power to the bus interface for supplying bus power.

In an embodiment, the control circuitry is an ASIC.

This provides the advantage that a well-known control circuitry can be used.

In an embodiment, a microcontroller controls the bus interface and is further configured to communicate with the ASIC.

In an embodiment, the control circuitry is further configured to detect fluctuations of the switch activity of the PFC circuitry and wherein the microcontroller is configured to make faster the time constant of the control circuitry if such fluctuations occur, or the ASIC on its own.

This provides the advantage that during DALI bus activities (falling and rising edges on the DALI bus), the fluctuations due to the tapping-off at the DC bus stage, which can be visible in the light output of the lighting means supplied by the following converter stage, are reduced.

In an embodiment, the LED-driver comprises an electromagnetic interference (EMI) filter.

This provides the advantage that the disturbance which is generated by external sources that may affect the electrical circuit by electromagnetic induction, electrostatic coupling, or conduction and which may degrade the performance of the circuit or even stop it from functioning is significantly reduced.

In an embodiment, the LED-driver comprises a half-bridge (HB)-LLC circuitry.

This provides the advantage that a high efficient circuitry is provided.

In an embodiment, the power factor correction (PFC) circuitry is a boost PFC circuitry.

This provides the advantage that the power factor correction shapes the input current of off-line power supplies to maximize the real power available from the mains.

In an embodiment, the LED-driver comprises two optocouplers arranged between the microcontroller and the bus interface, wherein the optocouplers are configured to provide optical isolation of the microcontroller from the bus interface.

In an embodiment, the LED-driver comprises two transformers, wherein the transformers are configured to provide insulation to the LED-driver.

In an embodiment, the LED-driver comprises a first side and a second side and the second side comprises a module configured to perform rectification and sensing on an output current of the LED-driver.

In an embodiment, the voltage supply is 12 V.

In an embodiment, the bus interface is a DALI interface.

This provides the advantage that a well-known interface is provided.

According to a second aspect, the invention relates to a method for reducing fluctuations on an LED-driver, comprising tapping off an output voltage of an active PFC a voltage supply for a bus interface for powering a bus, and feedback controlling of an output voltage of the active PFC by controlling a switch of the PFC, wherein the time constant of the feedback controlling is faster during time periods in which the bus interface is transmitting or receiving signals over the bus compared to time periods without activity.

According to a third aspect, the invention relates to a computer program comprising a computer product for performing the method of the second aspect.

BRIEF DESCRIPTION OF THE DRAWINGS

The invention will be explained in the following together with the figures.

DETAILED DESCRIPTION

Figure 1:
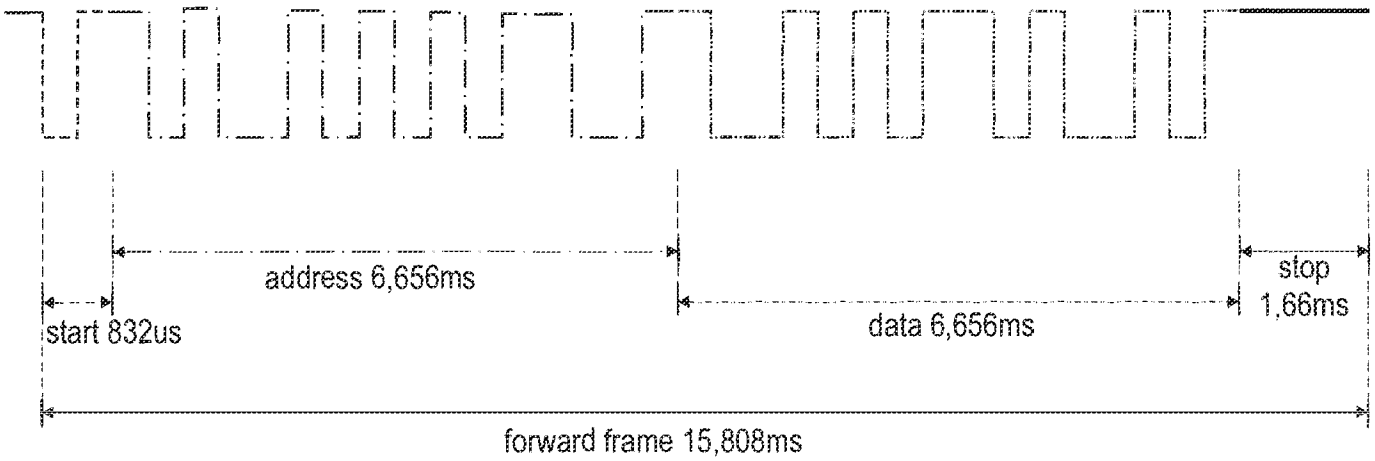
FIG. 1 shows an example of a DALI forward frame.

Aspects of the present invention are described herein in the context of an LED-driver.

The present invention is described more fully hereinafter with reference to the accompanying drawings, in which various aspects of the present invention are shown. This invention however may be embodied in many different forms and should not be construed as limited to the various aspects of the present invention presented through this disclosure. Rather, these aspects are provided so that this disclosure will be thorough and complete, and will fully convey the scope of the present invention to those skilled in the art. The various aspects of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus.

Various aspects of a LED-driver will be presented. However, as those skilled in the art will readily appreciate, these aspects may be extended to aspects of LED-drivers without departing from the invention.

The term "LED luminaire" shall mean a luminaire with a light source comprising one or more LEDs. LEDs are well-known in the art, and therefore, will only briefly be discussed to provide a complete description of the invention.

It is further understood that the aspect of the present invention might contain integrated circuits that are readily manufacturable using conventional semiconductor technologies, such as complementary metal-oxide semiconductor technology, short "CMOS". In addition, the aspects of the present invention may be implemented with other manufacturing processes for making optical as well as electrical devices. Reference will now be made in detail to implementations of the exemplary aspects as illustrated in the accompanying drawings. The same references signs will be used throughout the drawings and the following detailed descriptions to refer to the same or like parts.

Figure 3:
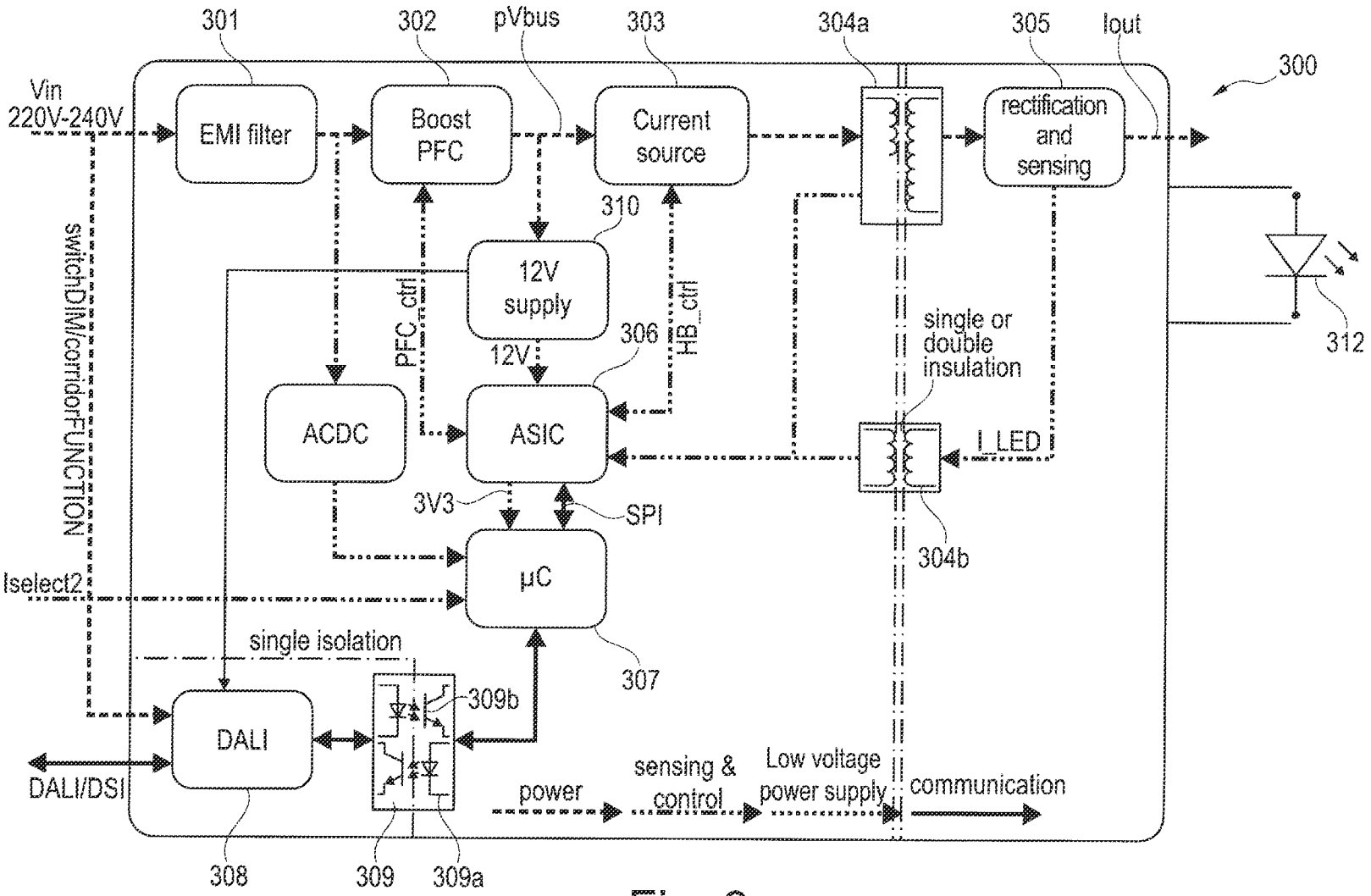
FIG. 3 shows a schematic representation of an LED-driver according to an embodiment.

Now referring to FIG. 3, a schematic representation of a LED-driver 300 is shown according to an embodiment.

The LED-driver 300 comprises an actively switched PFC circuitry 302 and a bus interface 308 for a wire-bound bus. Preferably a low voltage voltage supply 310 for the bus interface 308 for powering the bus is tapped off the output voltage of the actively switched PFC circuitry 302. The low voltage power supply draws higher electrical energy during time periods of activity on the bus.

The low voltage power supply 310 may furthermore supply integrated circuits, such as e.g. the ASIC and the μc.

The LED-driver 300 comprises further a control circuitry 306 for a feedback control of an output voltage of the actively switched PFC 302 by controlling a switch of the actively switched PFC 302, wherein the time constant of the feedback control of the control circuitry 306 is faster during time periods in which the bus interface 308 is transmitting or receiving signals, compared to time periods without activity.

Therefore, advantageously, in order to reduce the fluctuations of the DC bus voltage by feedback control, the PFC control time constant should be made fast. In order to avoid problems occurring with a constantly fast PFC feedback control, the control time constant of the PFC control circuitry is only made faster in time periods during which there is communication activity on the bus interface such as a DALI bus.

In one embodiment, a microcontroller 307 in the LED-driver 300, responsible for the communication over the DALI interface 308, selectively increases the control speed of the actively switched PFC 302 in time periods in which it either sends out DALI signals over the DALI interface 308, or upon the detection of incoming DALI signals from the bus.

In another embodiment, the control circuitry 306 (typically an ASIC) carrying out the feedback control of a switch of the PFC circuitry 302 directly detects fluctuations which are typically caused by DALI bus activities and directly increases the feedback control time constant upon detection of such fluctuations.

Furthermore, the DALI interface circuit 308 can be configured to transmit and receive signals between the DALI network and the microcontroller 307. Digital data conforming to the DALI protocol can be transmitted over lines through a bridge rectifier (not shown in FIG. 3).

The digital data received from the DALI network can be converted into digital signals and transmitted and received to and from the microcontroller 307. The microcontroller 307 can control the ASIC 306 by sending signals to perform actions such as, for example, to dim a lamp 312 or to turn on or off the ASIC 306. The microcontroller 307 can receive signals from the ASIC 306 such as, for example, lamp fault detection purposes. The ASIC 306 can determine whether the lamp 312 should be on or off based on fault conditions exhibited by the lamp 312.

The conventional DALI interface circuit can include a zener diode and a resistor coupled between the rectifier and an optocoupler on the receive side. The conventional DALI interface circuit also includes a bipolar junction transistor, and a resistor coupled to the rectifier and an optocoupler on the transmit side.

In an embodiment, the LED-driver 300 comprises an electromagnetic interference (EMI) filter 301, a current source 303, a rectification and sensing unit 305, transformers 304*a* and 304*b*, and two optocouplers 309*a* and 309*b* in unit 309.

In particular, the LED-driver 300 can include two 4-pin optocouplers 309*a* and 309*b* in order to optically isolate the microcontroller 307 from the digital data received from the DALI network.

The isolation circuit 309 may be coupled between the interface circuit 308 and the microcontroller 307, the isolation circuit 309 being structured to optically isolate the interface circuit 308 from the microcontroller 307. The isolation circuit 309 may protect other components of the LED-driver 300 (e.g., the microcontroller 307) from transient voltages or currents.

The isolation circuit 309 may include saturating optocouplers 309*a* and 309*b*. Saturating optocouplers used in the isolation circuit 309 may include an additional terminal coupled to the base of the BJT of the optocoupler, the terminal being coupled to a resistor to achieve substantially a 50% even duty cycle. Otherwise, an unwanted charge builds on the base of the BJT of the optocoupler, which substantially slows the switching speed of the optocoupler. The terminal coupled to the base of the BJT of the saturating optocoupler can be coupled to a resistor, which is coupled to the gate of a transmitting transistor. A capacitor can also be coupled to the base of the BJT of the saturating optocoupler. The terminal coupled to the base of the BJT of the saturating optocoupler 309*a* can be coupled to a resistor, which may be coupled to ground.

Figure 2:
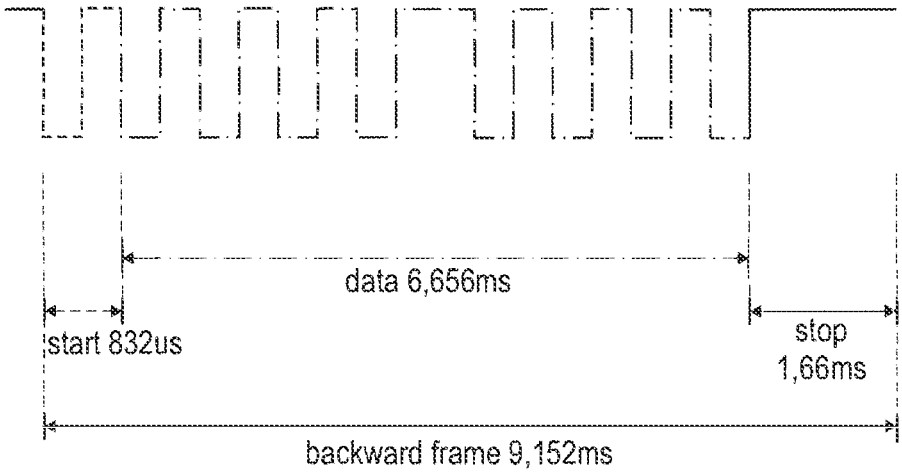
FIG. 2 shows an example of a DALI backward frame.

The digital signals received from the network over the terminals of the DALI interface 308 can be received via a bridge rectifier. The received digital signals can include at least one forward frame (see FIG. 1). Similarly, the digital signals transmitted to the network over the terminals of the DALI interface 308 can be sent via the bridge rectifier. The transmitted digital signals may include at least one backward frame (see FIG. 2).

A forward frame may be a sequence of bits used to transmit data from a master or transmitting node to a slave/remote or receiving node.

A backward frame may be a sequence of bits used to return data from the slave/remote or receiving node to the master or transmitting node.

Furthermore, the transformers 304*a* and 304*b* can be configured to provide single or double insulation to the LED-driver 300.

The actively switched PFC can be a boost PFC.

Figure 4:
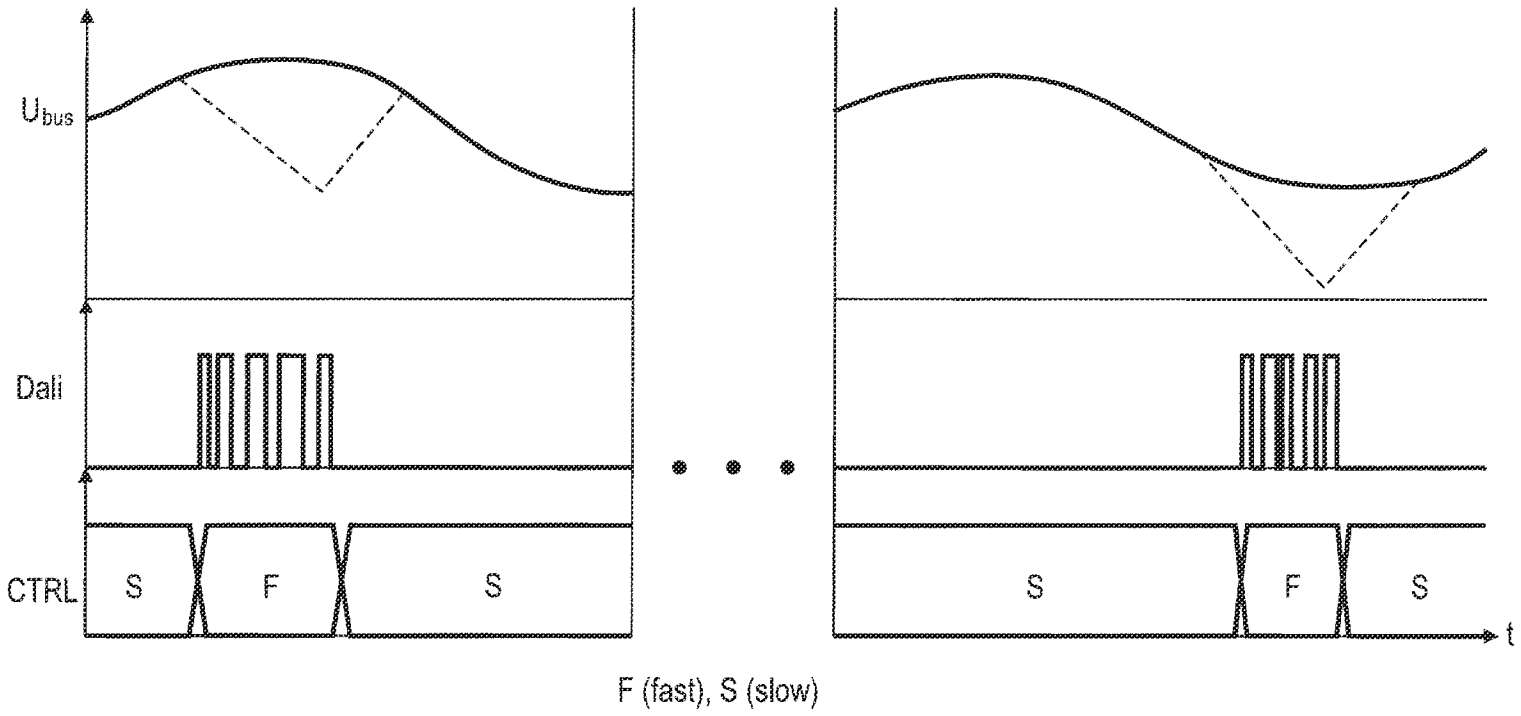
FIG. 4 shows a schematic representation of different voltages ($V_{bus}$, $V_{dali}$ and $V_{ctrl}$) in a LED-driver as a function of time.

In FIG. 4, a schematic representation of the voltage of the bus $V_{bus}$, the interface $V_{DALI}$ and the control circuitry 307 $V_{ctrl}$ is given as a function of time.

As it can be taken from FIG. 4, when there is DALI activity, the PFC control time constant is made fast (F), while when there is no DALI activity, the PFC control time constant is made slow (S).

Figure 5:
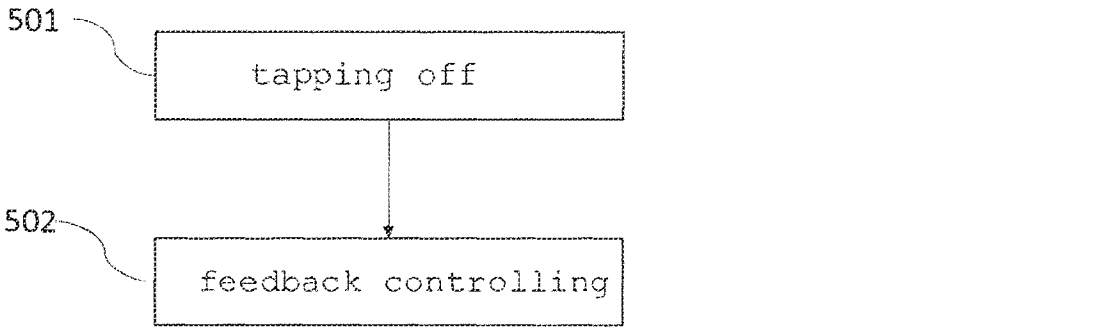
FIG. 5 shows a schematic representation of a method for reducing fluctuations on an LED-driver according to an embodiment.

FIG. 5 shows a schematic representation of a method 500 for reducing fluctuations on an LED-driver 300 according to an embodiment.

The method 500 for reducing fluctuations on the LED-driver 300 comprises the following steps:

tapping off 501 an output voltage of an actively switched PFC 302 a voltage supply for a bus interface 308 for powering a bus; and feedback controlling 502 of an output voltage of the actively switched PFC 302 by controlling a switch of the PFC; wherein the time constant of the feedback controlling 502 is faster during time periods in which the bus interface 308 is transmitting or receiving signals over the bus compared to time periods without activity.

All features of all embodiments described, shown and/or claimed herein can be combined with each other.

While various embodiments of the present invention have been described above, it should be understood that they have been presented by way of example only and not limitation. Numerous changes to the disclosed embodiments can be made in accordance with the disclosure herein without departing from the spirit of scope of the invention. Thus, the breadth and scope of the present invention should not be limited by any of the above-described embodiments. Rather, the scope of the invention should be defined in accordance with the following claims and their equivalence.

Although the invention has been illustrated and described with respect to one or more implementations, equivalent alternations and modifications will occur to those skilled in the art upon the reading of the understanding of the specification and the annexed drawings. In addition, while a particular feature of the invention may have been disclosed with respect to only of the several implementations, such features may be combined with one or more other features of the other implementations as may be desired and advantage for any given or particular application.

The invention claimed is:

1. An LED-driver (300), comprising:

an actively switched PFC circuitry (302);

a bus interface (308) for a wire-bound bus, the bus interface being arranged for supplying power to the wire-bound bus;

a microcontroller (307) configured to control the bus interface (308);

a bus power supply unit supplying a DC power to the bus interface and supplied by an output voltage of the actively switched PFC circuitry such that a voltage supply for the bus interface (308) for powering the wire-bound bus is tapped off the output voltage of the actively switched PFC circuitry (302); and a control circuitry (306) for a feedback control of the output voltage of the actively switched PFC (302) by the control circuitry (306) controlling a switch of the actively switched PFC (302); wherein the control circuitry (306) applies a faster time constant for the feedback control during time periods in which the bus interface (308) is transmitting or receiving signals, compared to time periods during which the bus interface (308) is not transmitting or receiving signals.

2. The LED-driver (300) of claim 1, wherein the control circuitry (306) is an ASIC.

3. The LED-driver (300) of claim 2, wherein the microcontroller (307) is further configured to communicate with the ASIC (306).

4. The LED-driver (300) of claim 1, wherein the wire-bound bus is a DALI bus and the control circuitry (306) is further configured to detect fluctuations caused by DALI bus activities and directly decreases the feedback control time constant upon detection of such fluctuations of said fed-back output voltage.

5. The LED-driver (300) of claim 1, wherein the LED-driver (300) comprises an EMI filter (301).

6. The LED-driver (300) of claim 1, wherein the LED-driver (300) comprises a current source circuitry (303).

7. The LED-driver (300) of claim 1, wherein the PFC circuitry (302) is a boost PFC circuitry.

8. The LED-driver (300) of claim 1, wherein the LED-driver (300) comprises two optocouplers (309*a*, 309*b*) arranged between the microcontroller (307) and the bus interface (308), wherein the optocouplers (309*a*, 309*b*) are configured to provide optical isolation of the microcontroller (307) from the bus interface (308).

9. The LED-driver (300) of claim 1, wherein the bus interface (308) is a DALI interface.

10. A method (500) for reducing output voltage fluctuations on an LED-driver (300), comprising:

tapping off (501) an output voltage of an actively switched PFC (302) to provide a voltage supply for a bus interface (308) for powering a wire-bound bus; and feedback controlling (502) of said output voltage of the actively switched PFC (302) by controlling a switch of the actively switched PFC (302);

wherein a time constant of the feedback controlling (502) is made faster during time periods in which the bus interface (308) is transmitting or receiving signals over the bus compared to time periods without activity.

11. A non-transitory computer program product for performing the method (500) of claim 10.

* * * * *